US005228251A

United States Patent [19]

Frigon

[11] Patent Number: 5,228,251

[45] Date of Patent: Jul. 20, 1993

[54] EXTENDABLE POLE

[75] Inventor: Robert O. Frigon, Deer Park, Md.

[73] Assignee: Modern Technology Corp., Dayton, Ohio

[21] Appl. No.: 821,987

[22] Filed: Jan. 16, 1992

[51] Int. Cl.[5] ..... E04G 25/00; E04H 12/18

[52] U.S. Cl. ..... 52/111; 52/118; 52/123.1; 52/632

[58] Field of Search ..... 52/111, 123.1, 632, 52/117, 118; 135/75; 248/423, 157, 188.5; 403/109; 138/156, 157, 162, 163, 166

[56] References Cited

U.S. PATENT DOCUMENTS

| | | | |
|---|---|---|---|
| 930,406 | 8/1909 | McDonald | 248/188.5 |
| 1,391,495 | 9/1921 | Parsons | 403/109 |
| 1,824,192 | 9/1931 | Bouma | 135/75 |
| 2,658,241 | 11/1953 | Houghton, Jr. et al. | 52/632 |
| 3,282,001 | 11/1966 | Bigalow | 52/632 |
| 3,378,928 | 4/1968 | Durand | 52/632 |
| 3,987,807 | 10/1976 | Varnell | 135/45 R |
| 4,135,274 | 1/1979 | Freeman | 15/244 R |
| 4,357,785 | 11/1982 | Ecklund | 52/632 |

*Primary Examiner*—Carl D. Friedman
*Assistant Examiner*—Matthew E. Leno
*Attorney, Agent, or Firm*—Biebel & French

[57] ABSTRACT

An extendable pole or mast is constructed from a plurality of nested pole sections with each pole section is made from an initially flat sheet which is roll formed into a rectangular, preferably square, cross section element. A seam is formed by over lapping the edges of the sheet, with the bulk of the seam being placed inwardly of the element. Each of the inner sections includes its own seam and an offset of sufficient size and depth to receive the seam and offset of an outer sections. The sheet material permits tabs to be cut or stamped into outer walls of the outer sections in order to support an adjacent inner pole section. Tabs are formed in each of the outer pole sections. These tabs are biased to extend inwardly, against the adjacent inner pole section. Tabs may be formed below the first tab to provide a choice in the amount of extension of the pole.

2 Claims, 2 Drawing Sheets

EXTENDABLE POLE

BACKGROUND OF THE INVENTION

This invention relates to extendable poles of the type used to support camouflage netting, lights, antennas and the like.

Extendable poles or telescopic masts have been in use for a considerable period of time, but many of the prior art devices are relatively complex in their construction and expensive to construct.

There is a present need for a simple and inexpensive extendable pole that may be stored for long periods of time, which is easy to operate, which can extend to a plurality of different lengths, and which may be disassembled and returned to storage.

SUMMARY OF THE INVENTION

In the present invention, an extendable pole or mast is constructed from a plurality of nested pole sections. Each pole section is formed from an initially flat, elongated rectangular sheet having parallel edges which is roll formed into a rectangular, preferably square, cross-section element. A joint or seam is formed by overlapping the edges of the sheet along the length of the pole section, with the bulk of the seam being placed inwardly of the pole section.

In the preferred embodiment, there are four pole sections. Each of the inner sections includes its own joint and at least one relief, notch or offset of sufficient size and depth to receive the joint and notch of the outer sections. Thus, the first inside section includes only one notch to receive the joint of the outermost section; the second inside section includes two notches to accommodate the joint of the second section and the second section's notch; and the third inside section includes three notches.

The sheet material is preferably of steel or aluminum which is both thinner and stronger than the materials used in making extruded elements. This thinner and stronger material permits tabs to be cut or stamped into outer walls of the outer sections in order to support an adjacent inner pole section. These tabs are biased to extend inwardly, against the adjacent inner pole section. Additional tabs may be formed below the first tab to provide a choice in the amount of extension.

Accordingly, it is an object of this invention to provide a multi-section, extensible pole comprising a plurality of nested pole sections, each pole section formed from a flat sheet into a rectangular cross-section element having an overlapping joint, each of the inner pole sections including a relief formed on at least one side to accommodate the overlapping joint formed on an adjacent outer pole section, and at least one tab formed in each of the outer pole sections for supporting an adjacent inner pole section as the inner pole sections are extended.

It is a further object of this invention to provide a multi-section, extensible pole comprising a plurality of nested pole sections, each pole section being rectangular in cross-section and having roll-formed interlocking edges, each of the inner pole sections including at least one offset formed to accommodate the interlocking edges of the outer pole section, and at least one tab formed in each of the outer pole sections for supporting an adjacent inner pole section as the inner pole sections are extended from a nested position.

Other objects and advantages of the invention will be apparent from the following description, the accompanying drawings and the appended claims.

DESCRIPTION OF THE PREFERRED EMBODIMENT

Figure 1:
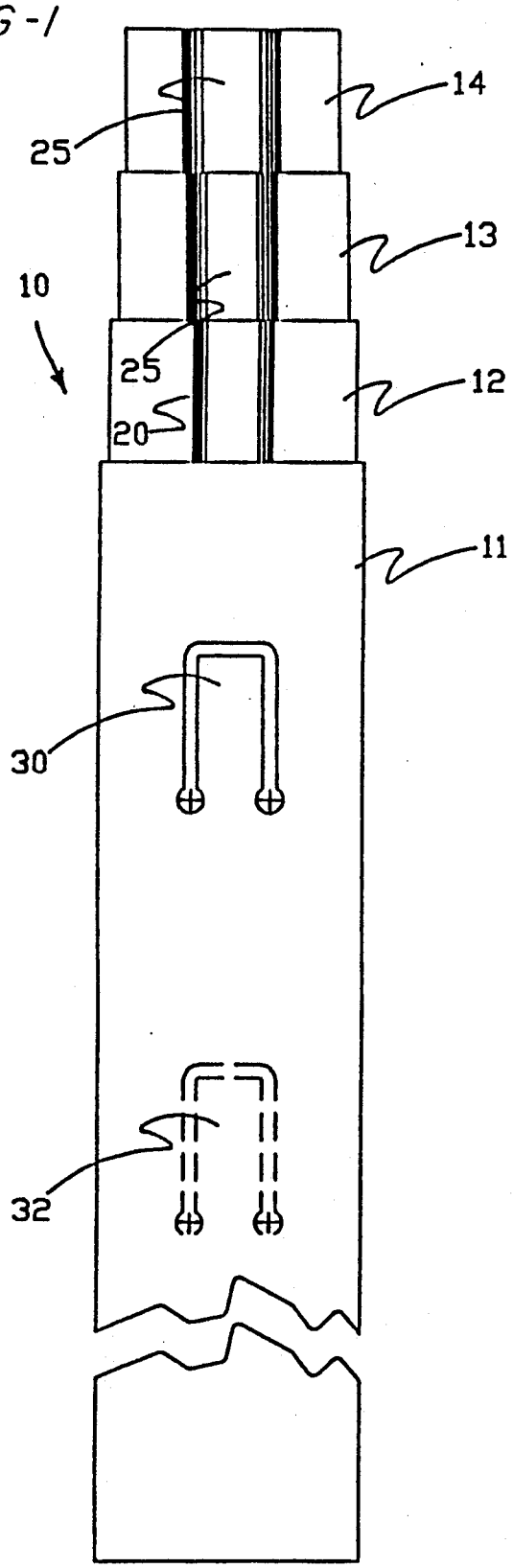
FIG. 1 is an elevational view showing an extendable pole constructed according to this invention employing four nested pole sections.

Referring now to the drawings which illustrates a preferred embodiment of the invention, and particularly to FIG. 1, an extendable pole 10 includes a set of four nested pole sections 11, 12, 13 and 14, with section 11 being the outermost section and section 14 being the innermost section.

Figure 2:
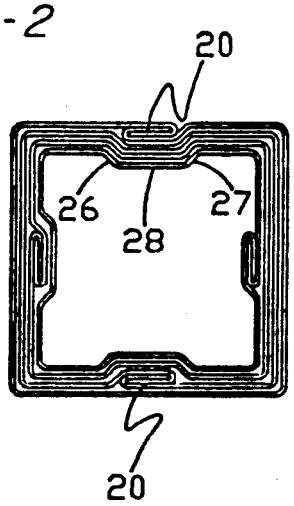
FIG. 2 is an end view of the nested poles of FIG. 1.

Each pole section is made of an initially flat sheet that is roll formed into a rectangular, preferably square, cross-section element that is joined on one side at 20 by interlocking edges, as shown in FIG. 2. Constructing the pole sections in this manner permits the use of thinner materials than possible with extrusions, and it also permits the use of stronger materials.

As shown in FIG. 2, each section has a joint 20 placed in the middle of one side, with the overlapping materials facing inwardly. Each adjacent inner pole section is provided with a notch or offset 25 to accommodate the joint 20 and any notches on an outer section. Each offset includes inclined sections 26 and 27 and a flat section 28 that is parallel to the outer plane of the pole.

Thus, the outermost section 11 has one joint 20 while section 12 has a joint 20 and a notch 25 placed opposite the joint. Section 13 has a joint 20 and two notches 25, and section 14 has a joint 20 and three notches 25. The notches 25 provide additional bending strength, stability and stiffness to the pole sections.

As used herein, the term inner pole section is defined as any section immediately inside an outer pole section, and the term outer pole section is defined as any section outside an inner pole section. Accordingly, there are three inner sections, sections 12–14 and three outer sections, sections 11–13.

Figure 4:
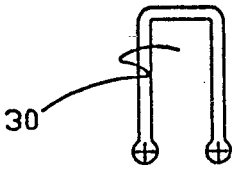
FIG. 4 is an enlarged elevational view showing one of the tabs formed in an outer pole section.
Figure 5:
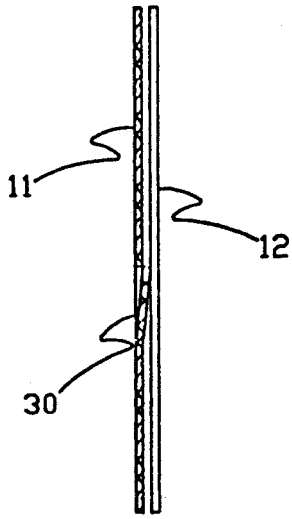
FIG. 5 is an enlarged elevational view of a portion of a pair of nested pole sections showing a tab in it retracted position.

Each of the outer pole sections is provided with tabs 30 placed on the side of the section. In some cases, additional tabs 32 may also be provided. The tabs are formed by cutting a U-shaped slot in the sides of the pole sections, as shown in FIG. 4. The tabs are biased inwardly and normally engage the outer surface of an inner pole section, as illustrated in FIG. 5.

Figure 3:
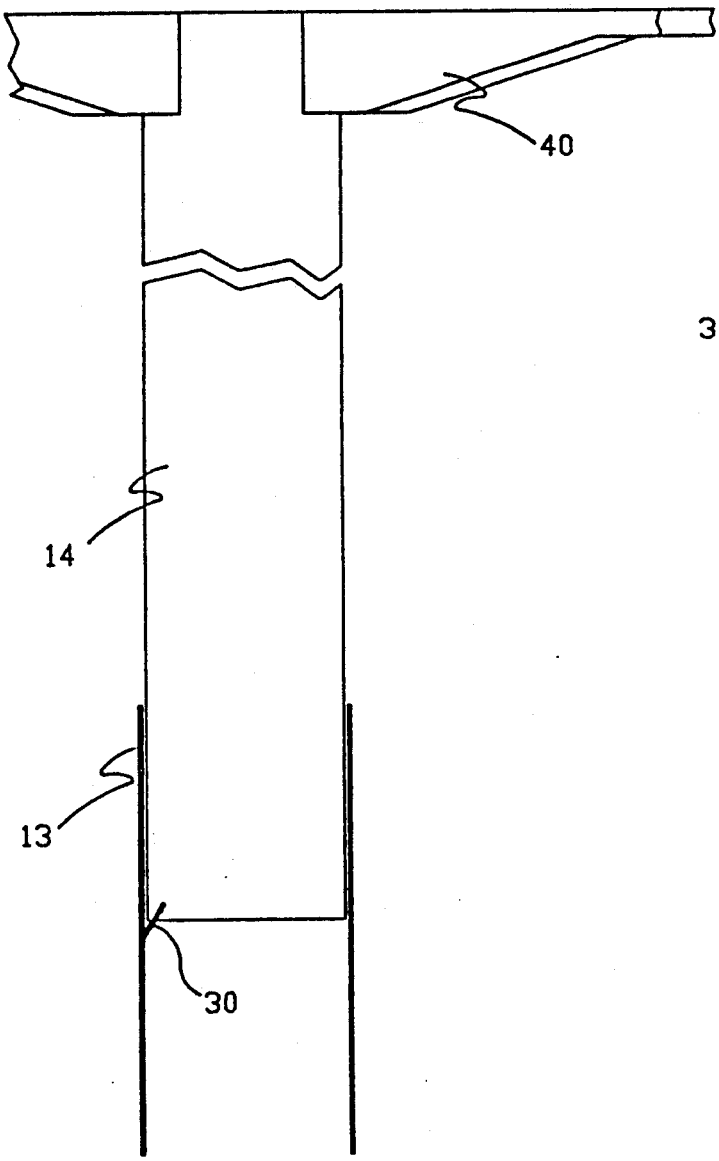
FIG. 3 is an elevational view, partly in cross section, showing an inner pole section resting on tabs formed on an outer pole section.

As an inner pole section is extended, that is, moved upwardly relative to an outer pole section, the bottom edge of the inner section will eventually pass the top edge of the tab, and the tab will extend inwardly. The inner section may then be lowered slightly, as shown in FIG. 3, with the bottom of the inner section resting against the tab. Thus, an inner section is supported in its extended position by the tabs of an outer section.

Tabs 32 may be provided in the outer sections below the tabs 30 to permit an inner section to be extended only partially.

When it is desired to retract a pole section, it must be lifted a short distance to clear the tab and the tab may be bent outwardly using a key, coin or other simple, flat device. This allows the inner pole to slide downwardly inside the outer pole. The poles may also be withdrawn completely and reinserted into the opposite end, allowing all the poles to nest.

In a typical embodiment of this invention, pole section 11 is 4 feet in length, pole section 12 is 4.5 feet, pole section 13 is 5 feet and pole section 14 is 5.5 feet. Tabs 30 are placed one foot below the top edge of each section, thus providing a maximum extended pole length of 16 feet. If the second set of tabs 32 are used, and all the sections extended to the lower tabs, then the extended pole length is 12 feet. Of course, if not all of the sections are extended, the length of the pole may be made incrementally shorter.

The poles may be stowed within each other, with a maximum length of 5.5 feet and a square outside cross section that faciliates packaging multiple assemblies. No pins or special devices are required to lock the pole sections into their extended position.

A disrupter element 40 is normally positioned at the top of each pole, as shown in FIG. 3. The disrupter element increases the effective area of the pole where it contacts the supported camouflage netting.

While the form of apparatus herein described constitutes a preferred embodiment of this invention, it is to be understood that the invention is not limited to this precise form of apparatus and that changes may be made therein without departing from the scope of the invention, which is defined in the appended claims.

What is claimed is:

1. A multi-section, extensible pole comprising a plurality of nested pole sections, each pole section formed from a flat, elongated rectangular sheet having parallel edges into a rectangular cross-section element with one set of the edges of each sheet, each pole section having an upper end and a lower end, each pole section of the inner pole sections including a relief formed on at least one side to receive the seam formed on an adjacent outer pole section, and at least one tab formed in each pole section that is outside another pole section, said tab being biased toward the inner pole section for receiving the lower end of the inner pole section as the inner pole section is extended upwardly relative to said outer pole section.

2. A multi-section, extensible pole comprising a plurality of nested pole sections, each pole section formed from a flat, elongated rectangular sheet having parallel edges into a rectangular cross-section element with one set of the parallel edges of each sheet roll formed to provide a longitudinal seam, each pole section having upper and lower ends, each of the inner nested pole sections including at least one longitudinally extending offset formed to provide a relief to receive the longitudinal seam of next larger outer pole section, and at least one tab formed in each of the outer pole sections for supporting the bottom of an adjacent inner pole section as the inner pole sections are extended from a nested position.

* * * * *